United States Patent [19]

Delgrange et al.

[11] Patent Number: 4,575,721

[45] Date of Patent: Mar. 11, 1986

[54] AC PLASMA DISPLAY PANEL CONTROL CIRCUIT

[75] Inventors: Louis Delgrange; Francoise Vialettes; Jacques Deschamps, all of Paris, France

[73] Assignee: Thomson-CSF, Paris, France

[21] Appl. No.: 431,152

[22] Filed: Sep. 30, 1982

[30] Foreign Application Priority Data

Oct. 23, 1981 [FR] France ..... 81 19941

[51] Int. Cl.[4] ..... G09G 3/28

[52] U.S. Cl. ..... 340/776; 340/777; 340/800; 315/169.4

[58] Field of Search ..... 340/773, 776, 777, 771, 340/758, 800; 315/169.4, 171

[56] References Cited

U.S. PATENT DOCUMENTS

| | | | |
|---|---|---|---|
| 3,821,596 | 6/1974 | Leuck | 340/776 |
| 3,846,646 | 11/1974 | Peters | 340/776 |
| 3,867,646 | 2/1975 | McCoy | 315/171 |
| 3,997,813 | 12/1976 | Chan et al. | 340/800 |
| 4,063,131 | 12/1977 | Miller | 340/776 |
| 4,316,123 | 2/1982 | Kleen et al. | 315/169.4 |
| 4,370,651 | 1/1983 | Reible, Sr. | 340/777 |
| 4,386,297 | 5/1983 | Itoh et al. | 315/169.4 |
| 4,392,084 | 7/1983 | Rebeschi et al. | 315/169.4 |

OTHER PUBLICATIONS

SID International Symposium Digest of Technical Papers, May 1976, 1st Edition, NY, Miller et al: "Bipolar Integrated . . . ", pp. 58–59.

*Primary Examiner*—Gerald L. Brigance
*Attorney, Agent, or Firm*—Roland Plottel

[57] ABSTRACT

This invention concerns an AC plasma display panel control circuit, comprising integrated circuits combined with a single amplifier to control one of the electrode networks, and integrated circuits combined with two amplifiers to control the other electrode network. The integrated circuits issue setting and erasure signals, and the amplifiers issue maintenance signals.

4 Claims, 17 Drawing Figures

AC PLASMA DISPLAY PANEL CONTROL CIRCUIT

BACKGROUND OF THE INVENTION

1. Field of the Invention

This invention concerns a control circuit for an AC plasma display panel.

Such plasma display panels are familiar in the prior art, for example in French patent application No. 78 04893, publication No. 2 417 848, filed on behalf of THOMSON-CSF, and in the article published in *Revue Technique Thomson-CSF,* June 1978, vol. 10, No. 2, pp. 249–275.

These panels comprise a large number of cells, arranged in matrix formation. Each cell is formed by the gas space at the intersection of two electrodes belonging to two orthogonal electrode networks, and receives control signals consisting of the difference in voltages reaching the two electrodes between which it is located.

Control signals comprise setting signals, to light the cells, erasure signals, to extinguish them, and maintenance signals, to keep the cells in their initial state, on or off.

2. Description of the Prior Art

In the prior art there are control circuits for AC plasma display panels, to issue panel control signals. The article already referred to mentions plasma display panel control circuits comprising a multiplexing network, which helps reduce the number of amplifiers needed to establish selective signals, i.e. setting and erasure cells.

This multiplexing network can be obtained by providing each electrode with two diodes and a resistor.

However, control circuits involving a multiplexing network have the following drawbacks:

since they contain a large number of amplifiers or transistors, resistors and condensors, they are bulky, and energy-consuming;

it is difficult to control several electrodes simultaneously.

An article published by TEXAS INSTRUMENTS in November 1980, *Bulletin SCA*-204, entitled "A. C. Plasma Display", describes integrated circuits involving "BIDFET" technology, used to control AC plasma display panels.

These integrated circuits comprise a single housing, which contains:

a logic circuit receiving instructions in low-voltage logic, defining the signal to be implemented, its duration, and the panel electrodes to be addressed;

a low-voltage/high-voltage interface circuit, controlled by the logic circuit, which receives DC voltages of 0 and 100 volts, and which comprises means of supplying each display panel electrode with two different voltages, 0 and 100 volts, depending on the instruction delivered to the logic circuit.

The advantages of these integrated circuits, compared with circuits composed of discrete components, are as follows:

compactness;

ease of addressing: the user issues instructions in low-voltage logic, and applies a DC voltage of 100 volts to the integrated circuits, instead of having to cope with high-voltage crenellations;

possibility of simultaneously addressing as many electrodes as required.

However, these integrated circuits involve the following disadvantages:

the technology used for integrated circuits on the market at present restricts the amplitude of output signals to 100 volts, whereas maintenance signals are crenellated voltages which normally range from −100 to +100 volts; this means that power supplies to integrated circuits connected to one of the electrode networks have to be made to "float" on crenellations with an amplitude of 100 volts;

control signals delivered by these circuits are voltage crenellations, so that it is no longer possible to obtain erasure and setting signals comprising a voltage gradient, as shown in FIGS. 3*a* and 4 of the patent application already referred to, whereas it is very useful to be able to use such erasure and setting signals, since this permits erasure and setting without the need to make delicate adjustments because of scattering of cell characteristics;

finally, the output resistance $R_{on}$ of the output amplifiers of these integrated circuits is much higher (approximately 100 times greater) than for discrete amplifiers, causing a sharp reduction in the luminance of plasma display: for large panels it may even cause a loss of recorded data.

SUMMARY OF THE INVENTION

This invention relates to a control circuit for an AC plasma display panel that avoids the drawbacks associated with existing control circuits.

It concerns a control circuit for an AC plasma display panel in which each electrode network is controlled by integrated circuits combined with at least one amplifier. In this invention, the integrated circuits are responsible for issuing setting and erasure signals, and the amplifier or amplifiers issue maintenance signals.

The control circuit proposed in this invention combines the advantages of integrated circuits and amplifiers formed of discrete components, as regards:

compactness;

ease of addressing in low-voltage logic, and simultaneously addressing of several electrodes.

The control circuit proposed in this invention offers the following specific advantages:

energy consumption for this circuit is less than for a control circuit using only integrated circuits, because only non-integrated amplifiers are in action when maintenance signals are being issued;

the invention uses integrated circuits with an output signals amplitude of 200 volts, so that it is no longer necessary to make power supplies "float", as has to be done with integrated circuits on the market, which have an output signal amplitude of not more than 100 volts;

the circuit can issue erasure and setting signals containing a voltage slope;

there is no loss of luminance or data in plasma display panels using the control circuit proposed in this invention, even though the output resistance of amplifiers in the integrated circuits used is high: only non-integrated amplifiers are used to issue maintenance signals; such amplifiers are usually constructed using bipolar technology and have a low output resistance $R_{on}$; on each alternation of the maintenance signal, a discharge current passes through each lit cell, reversing the memory voltage of the cell; the circuit used to issue maintenance signals must be capable of delivering or accepting this discharge current, which is a few tens of microamps per lit cell, during 0.1 to 0.2 μs, without the maintenance signal being deformed; consequently, the circuit to issue maintenance signals must have a low output resistance, and this applies to this new control circuit: when setting or erasure signals are being issued there is no or almost no discharge current, so that such signals can easily be issued by integrated circuits with high output resistance.

BRIEF DESCRIPTION OF THE DRAWINGS

Other purposes, features and advantages of the invention will emerge from the following description of one of the possible embodiments, with reference to the accompanying figures.

DESCRIPTION OF THE PREFERRED EMBODIMENTS

In these figures, the same references apply to the same components, but for reasons of clarity the dimensions and proportions of various parts are not observed.

Figure 1:
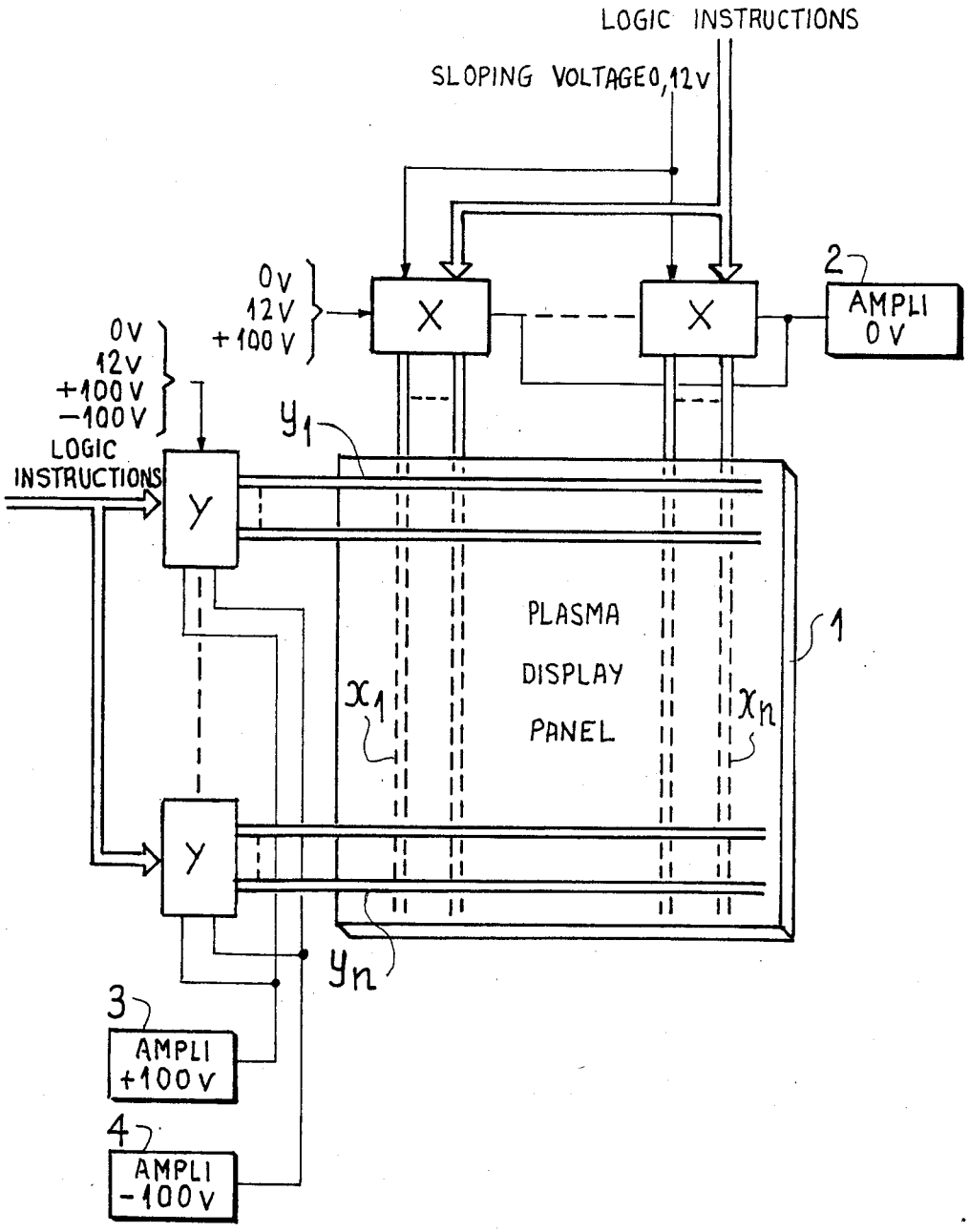
FIG. 1, showing a diagram of the structure of this new control circuit.

FIG. 1 shows the structure of the control circuit proposed in this invention. It shows a plasma display panel 1, comprising two orthogonal electrode networks $x_1$ to $x_n$ and $y_1$ to $y_n$.

This control circuit is formed of integrated circuits and amplifiers.

Electrodes $x_1$ to $x_n$ are controlled by integrated circuits X, combined with a single amplifier 2.

These integrated circuits are supplied with DC voltages of 0, 12 and 100 volts and by a sloping low-voltage signal, rising generally from 0 to 12 volts.

In addition, they receive low-voltage logic instructions as to the signal to be implemented, its duration, and the panel electrodes to be addressed.

Electrodes $y_1$ to $y_n$ are controlled by other integrated circuits Y, combined with two amplifiers 3 and 4.

These integrated circuits are supplied with DC voltages of 0, 12, +100 and −100 volts.

Like the other integrated circuits X, they receive low-voltage logic instructions.

Each integrated circuit X or Y can normally be used to control 32 electrodes.

A plasma display panel comprising 256 electrodes in each network x and y will have a control circuit of 8 integrated circuits X and a single amplifier to control network x, and 8 integrated circuits Y and two amplifiers to control network y.

Figure 2:
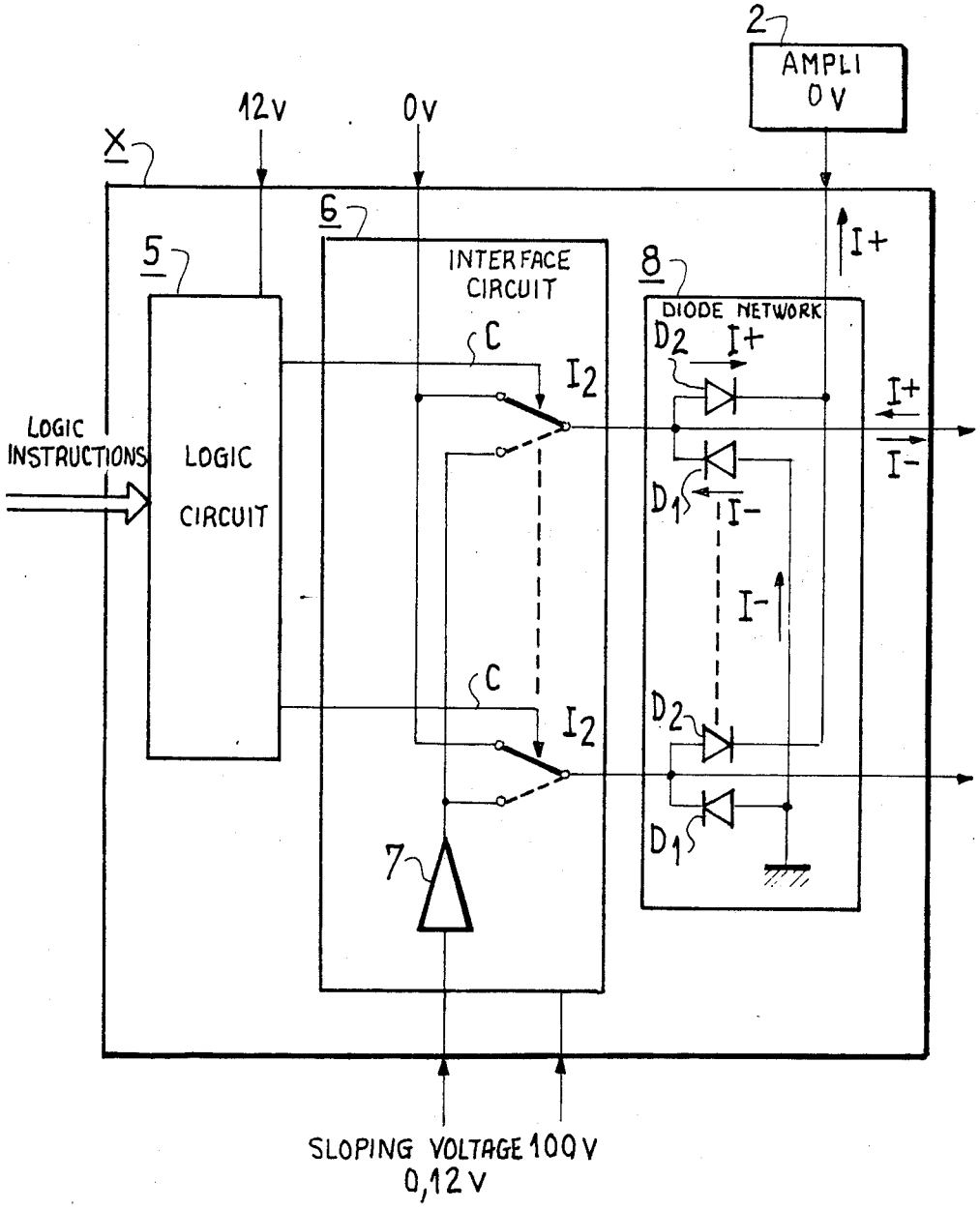
FIGS. 2 and 3, showing diagrams of the structure of the integrated circuits used in this new control circuit.
Figure 3:
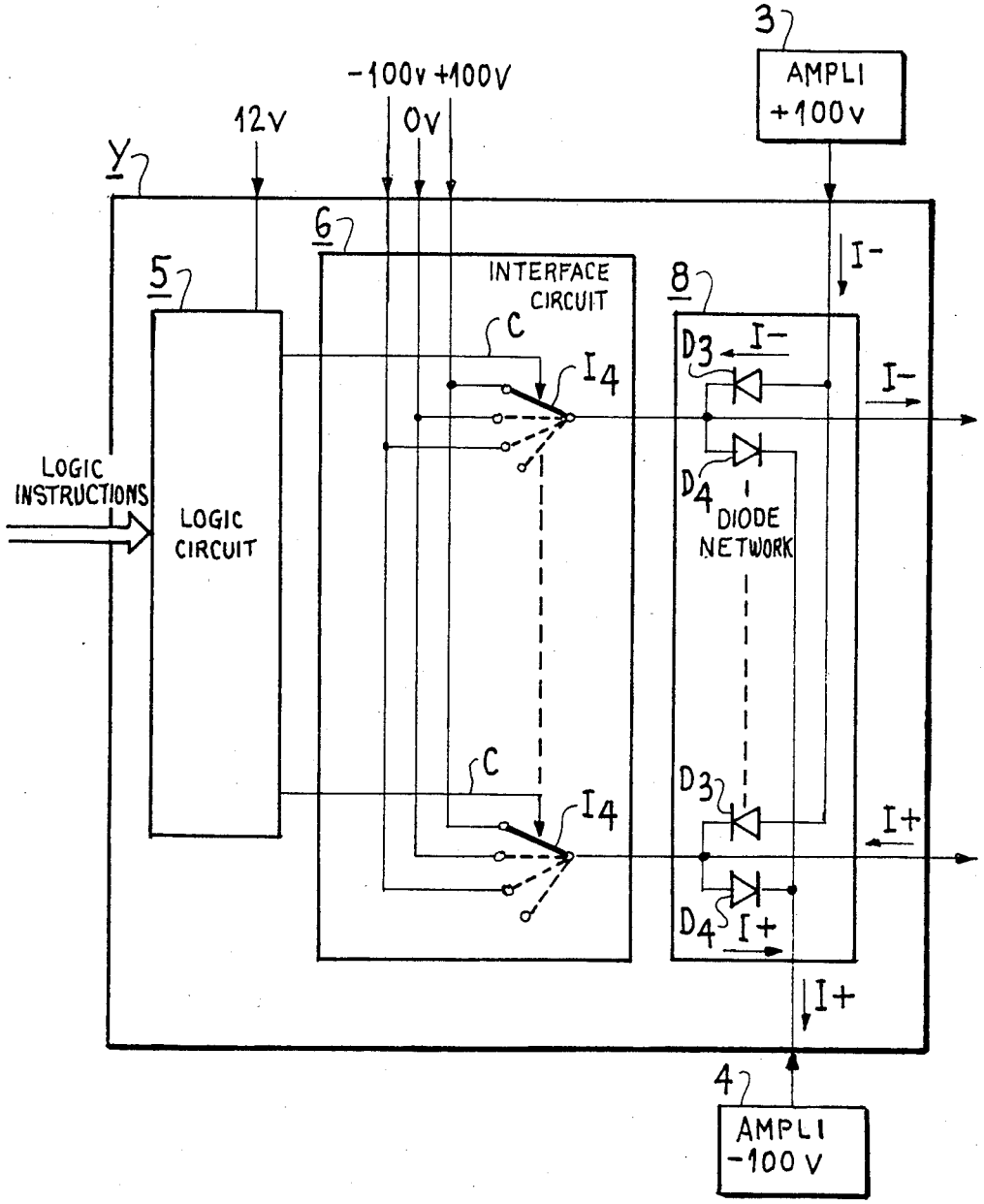

FIGS. 2 and 3 are diagrams of the structure of the integrated circuits X and Y used in this control circuit.

Each integrated circuit X and Y comprises three parts: a logic circuit 5, a low-voltage/high-voltage interface circuit 6, and a diode network 8.

The logic circuit 5 receives low-voltage logic instructions as to the signal to be implemented, its duration, and the panel electrodes to be addressed. This logic circuit 5 is supplied with a DC voltage of 12 volts.

It controls a low-voltage/high-voltage interface circuit 6, which comprises switch devices $I_2$ in FIG. 2, and $I_4$ in FIG. 3. These switches enable each electrode in the display panel to be energized at two different levels for the integrated circuits X in FIG. 2, which are combined with a single amplifier 2, and at four different levels for the integrated circuits Y in FIG. 3, which are combined with two amplifiers 3 and 4.

In accordance with the instruction delivered to the logic circuit 5 in FIG. 2, such instruction being transmitted by a control electrode C, each switch $I_2$ delivers to the panel electrode to which it is connected either 0 volts or a sloping high-voltage signal.

This interface circuit is supplied with DC voltages of 0 and +100 volts, and with a sloping low-voltage signal which varies in a straight line, generally from 0 to +12 volts, and which is amplified by an amplifier 7, forming part of the interface circuit 6. This enables the switches $I_2$ to deliver to panel electrodes either 0 volts or a sloping high-voltage signal which varies in a straight line, generally from 0 to 100 volts.

It is useful to supply each integrated circuit with a sloping low-voltage signal, since this makes it possible easily to adapt the slope from outside, to suit the characteristics of particular plasma display panels.

Similarly, in accordance with the instruction delivered to the logic circuit 5 in FIG. 3, such instruction being transmitted by a control electrode C, each switch $I_4$ delivers to the panel electrode to which it is connected either 0 volts, or approximately +100 volts, or approximately −100 volts. Finally, there is a fourth position for each such switch $I_4$ in which each switch delivers no voltage to the electrode y of the panel to which it is connected and presents a great impedance to the subsequent diode network 8. During issue of maintenance signals, switches are in this final position, isolating them from the diode network following them of the integrated circuit Y.

The interface circuit 6 in FIG. 3 receives supply voltages of 0 volts, approximately +100 volts and approximately −100 volts.

The low-voltage/high-voltage interface circuit 6 in the integrated circuits X and Y in FIGS. 2 and 3 is followed by a diode network 8, providing a link between the low-voltage/high-voltage interface circuit outputs, on the one hand, and amplifier outputs and panel electrodes, on the other.

FIG. 2 shows that each interface circuit output is connected to two diodes $D_1$ and $D_2$ mounted head-to-tail.

The cathode of diode $D_1$ is connected to an interface circuit output, and its anode to earth. The anode of diode $D_2$ is connected to one interface circuit output, and its cathode to the amplifier output.

FIG. 3 also shows that each output from the interface circuit 6 is also connected to two diodes $D_3$ and $D_4$, mounted head-to-tail.

The cathode of diode $D_3$ is connected to an interface circuit output, and its anode to the output of amplifier 3. The anode of diode $D_4$ is connected to an interface circuit output, and its cathode to the output of amplifier 4.

After this description of the structure of the control circuit proposed in this invention, its functioning will now be explained.

This will be done mainly with reference to FIGS. 4*a* to 4*e*, showing how maintenance signals are issued.

It is possible to produce maintenance signals by keeping electrodes on the front of the display panel at 0 volts and applying a crenellated voltage $V_y$ of about +100 V and −100 V to those on the back.

Figure 4:
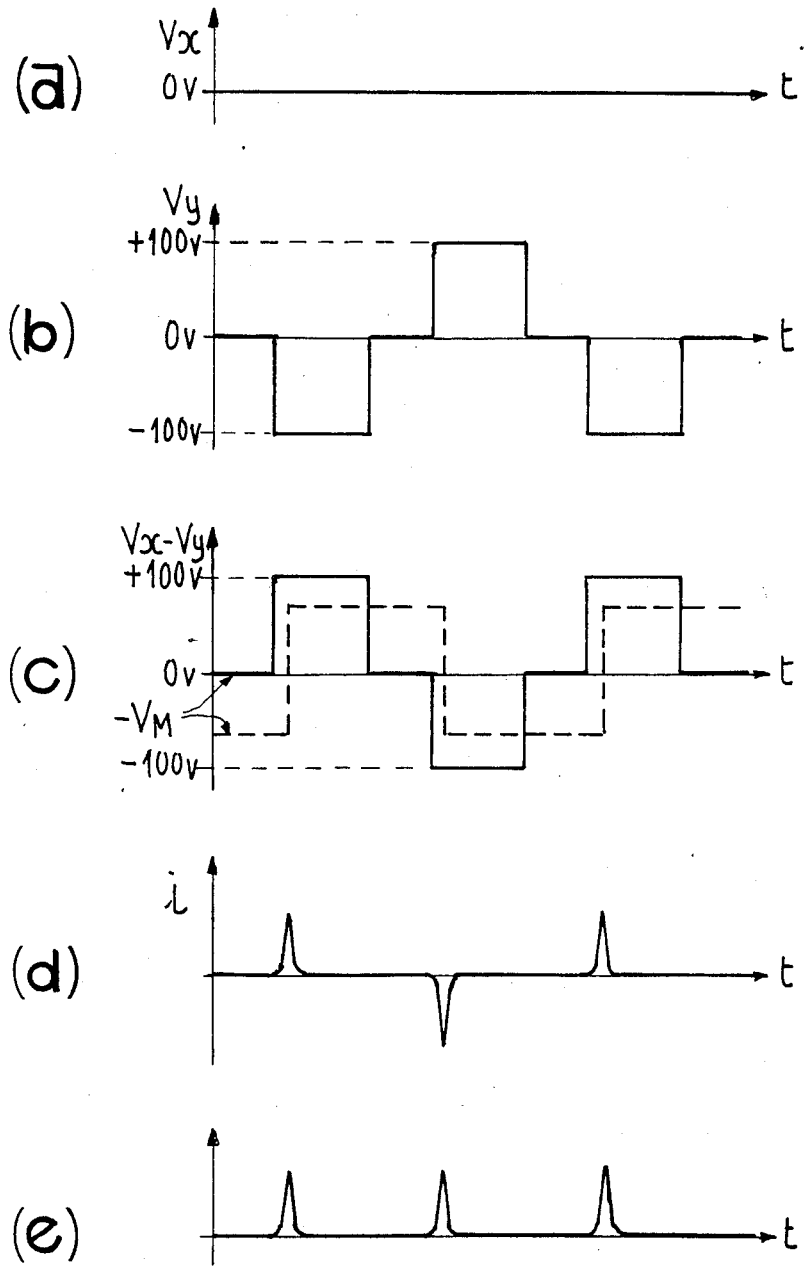
FIGS. 4*a* and 4*b*, showing voltages used for maintenance signals, FIG. 4*c*, showing the maintenance voltage, and FIGS. 4*d* and 4*e*, showing the discharge current in cells and light pulses emitted by cells.

FIG. 4 a shows the OV voltage $V_x$ supplied to electrodes on the front of the panel;

FIG. 4*b* shows the crenellated voltage $V_y$ supplied to electrodes in the back on the panel;

FIG. 4*c* shows the crenellated voltage $V_x$-$V_y$ supplied to each cell of the panel.

This figure shows, in a broken line, the memory voltage $V_M$ at the terminals of each cell.

Maintenance signals do not alter the status of cells. When a cell is off, its memory voltage remains null when it receives the maintenance signal. When a cell is lit, the memory voltage $V_M$ is reversed on each alternation of the maintenance signal.

FIG. 4*d* shows the discharge current i created in lit cells by maintenance signals.

This discharge current takes the form of pulses which change sign every time the maintenance signal alternates.

FIG. 4*e* shows the light pulses emitted by a cell which is lit and which receives the maintenance signal.

The control circuit issuing the maintenance signal must deliver or accept, depending on its direction, the discharge current, which is a few tens of microamperes for each lit cell, for a period of 0.1 to 0.2 microseconds.

Each integrated circuit in FIG. 2 must keep the electrodes to which it is connected at 0 volts.

In order to accept the discharge current $I^+$ flowing from the electrodes x to the integrated circuits X, each such electrode is connected to the amplifier 2 by diode $D_2$. The amplifier keeps the zero voltage at its output during alternation of the maintenance signal, when the control circuit has to accept the discharge current $I^+$. Diode $D_2$ is polarized directly, and lets the current $I^+$ flow towards the amplifier 2. Throughout the duration of the maintenance signal, the low-voltage/high-voltage interface circuit 6 supplies a zero voltage. Diode $D_1$ is polarized inversely, and the current $I^+$ can therefore no longer pass through.

To supply the discharge current $I^-$, flowing from the integrated circuits X to the electrodes x, each such electrode is connected to the cathode of diode $D_1$, the anode of which is connected to earth. During alternation of the maintenance circuit, where the control circuit has to deliver the discharge current $I^-$, the amplifier output is at or above 0 volts. The discharge current $I^-$ flows from earth to the electrodes through diodes $D_1$, without passing through diodes $D_2$.

In order to supply 0 volts to panel electrodes x, and deliver or accept discharge currents, an amplifier has to be used. If two diodes were placed head-to-tail and connected to earth at each interface circuit output, this would short-circuit all interface circuit output signals.

To issue maintenance signals, each integrated circuit Y in FIG. 3 has to supply crenellated voltages of approximately +100 and −100 volts, to the electrodes y to which it is connected.

In order to accept the discharge current $I^+$ flowing from the electrodes y to the integrated circuits Y during one of the alternations of the maintenance signal, each electrode y is connected to amplifier 4, by diode $D_4$. The amplifier output is then equal to about −100 volts, and it changes the electrodes to −100 volts.

During this alternation of the maintenance signal, the output of amplifier 3 is also about −100 volts, so that diode $D_3$ is inversed, and the current $I^+$ cannot pass through it. Through the duration of the maintenance signal, the low-voltage/high-voltage interface circuit 6 does not supply any voltage to the electrodes y. Switches $I_4$ are in their fourth position.

The discharge current $I^-$ flowing from the integrated circuits Y to the electrodes y is supplied, during one of the alternations of the maintenance signal, by amplifier 3, through diode $D_3$. The output of amplifier 3 is approximately +100 volts, and it changes the panel electrodes to +100 volts.

During this alternation of the maintenance signal, the output of amplifier 4 is also about +100 volts, so that diode $D_4$ is inversely polarized, and the current $I^-$ cannot pass through it.

After this explanation of how the control circuit proposed in this invention enables maintenance signals to be issued, the method of issuing selective signals will now be described, with reference to FIGS. 5 and 6*a* to 6*h*.

Figure 5:
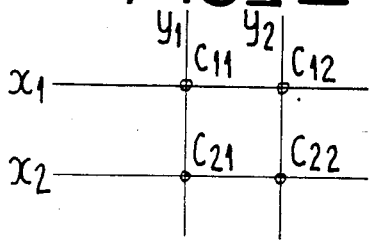
FIGS. 5 and 6*a* to 6*h*, showing a diagrammatical representation of some plasma display panel cells, voltages delivered by this control circuit, and control signals received by cells.

FIG. 5 is a diagrammatical view of four cells $C_{11}$, $C_{12}$, $C_{21}$ and $C_{22}$ of a plasma display panel, located at the intersections of two horizontal electrodes $x_1$ and $x_2$ and two vertical electrodes $y_1$ and $y_2$.

FIGS. 6*a* to 6*d* show the voltages $V_{x1}$, $V_{x2}$, $V_{y1}$ and $V_{y2}$ to be delivered to the electrodes $x_1$, $x_2$, $y_1$ and $y_2$, to keep cells $C_{11}$, $C_{12}$ and $C_{21}$ in their original state, and set cell $C_{22}$.

Figure 6:
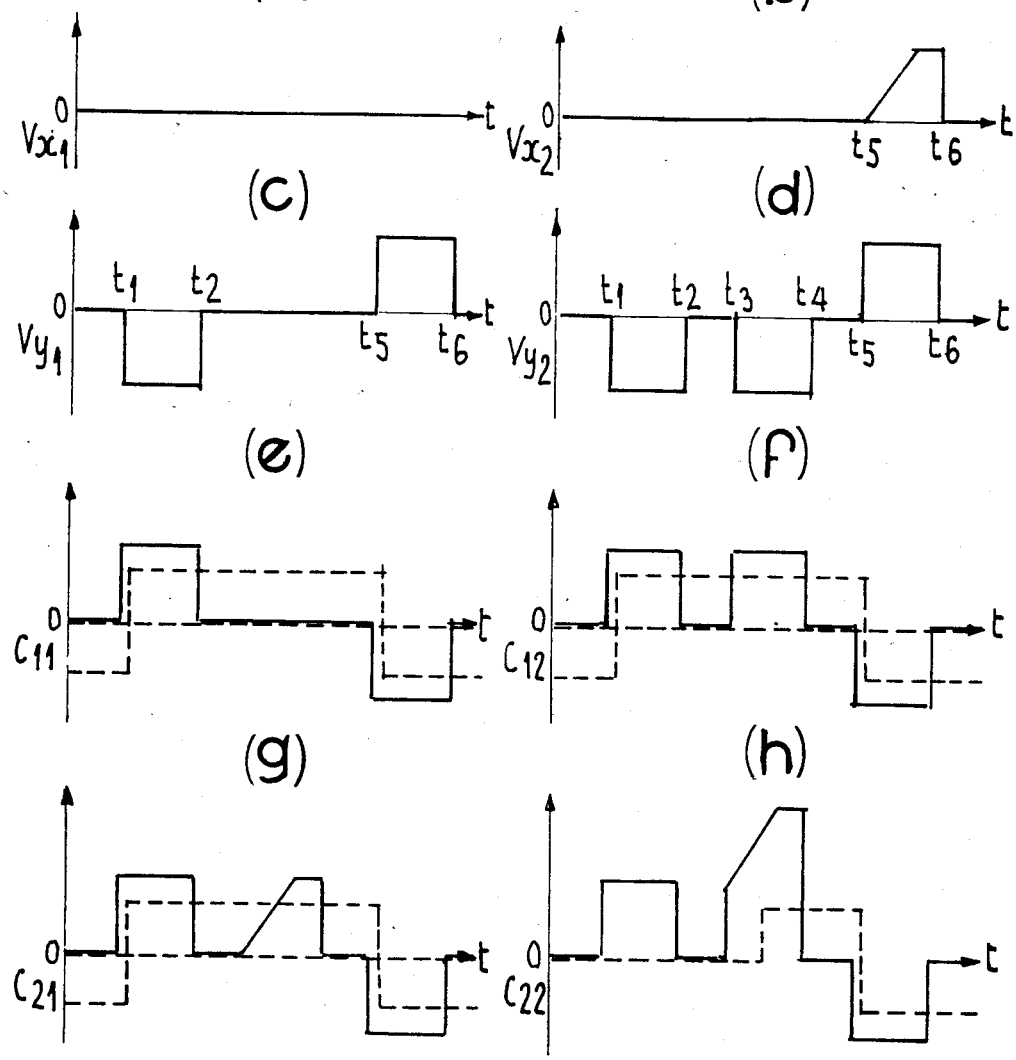

FIG. 6*a* shows that $V_{x1}$ is a zero voltage; FIG. 6*b* shows that $V_{x2}$ comprises a voltage gradient rising from 0 to +100 volts, stabilizing at 100 volts, then returning to 0.

$V_{y1}$ and $V_{y2}$ are formed of a sequence of two or three crenellations at + or −100 volts, as shown in FIGS. 6*c* and 6*d*.

FIGS. 6*e* to 6*h* show voltages obtained at the cell terminals $C_{11}$, $C_{12}$, $C_{21}$ and $C_{22}$. The memory voltage of these cells is shown by a broken line.

The integrated circuit X in FIG. 2 is used to establish voltages $V_{x1}$ and $V_{x2}$. The two positions of the switches $I_2$ allow 0 volts, and a voltage gradient rising from 0 to 100 volts, then stabilizing at 100 volts if desired, to be obtained. The amplifier output voltage is adjusted to 100 volts. When selective signals are being issued, diode $D_2$ is permanently inverted, and the amplifier 2 will not intervene.

The integrated circuit Y in FIG. 3 is used to establish voltages $V_{y1}$ and $V_{y2}$. Voltages of −100, +100 and 0 volts can be obtained by means of the switches $I_3$. The output voltage from amplifier 3 is adjusted to −100 volts, and the output voltage from amplifier 4 to +100 volts. When selective signals are being issued, diodes $D_3$ and $D_4$ are consequently permanently inverted, and amplifiers 3 and 4 do not come into action.

The description above mentions common values for voltages: +100, −100 and 0 volts. Naturally, the invention also applies to cases where other voltages are used, and where the two high DC voltages, which are usually −100 and +100 volts, have values $V_1$ and $V_2$, where $V_2$ exceeds $V_1$, and where the intermediate high DC high voltage between the two high DC voltages used to control the panel has a value $V_0$, where $V_0$ is less than $V_2$ and greater than $V_1$, whereas this intermediate voltage is usually 0 volts. It is in fact practical for $V_0$ to equal 0 volts.

What is claimed is:

1. A control circuit for an alternating current plasma display panel which comprises of matrix of light-emissive cells respectively connected between respective pairs of electrodes, the electrodes of each such pair being respectively connected to respective orthogonal networks of such electrodes; each cell being adapted to be switched on, off, or maintained in its existing state at any time in response to set, erase, or maintenance voltages, respectively, applied to the electrodes connected thereto; such control circuit comprising:

at least one integrated circuit for each of said networks, each such integrated circuit comprising an interface circuit for producing set and erase voltages for each of the electrodes in such network;

and a diode network connecting such interface circuit to each of such electrodes for applying the set and erase voltages produced thereby to such electrodes;

and at least one amplifier for each of said networks, each such amplifier having an output terminal which is connected by the diode network of the integrated circuit for such network to each of the electrodes to which such diode network applies said sets and erase voltages, each such amplifier producing a maintenance voltage which is applied by such diode network to each of such electrodes;

the diode network in each of said integrated circuits being adapted to isolate the amplifier connected thereto from the electrodes to such diode network when said interface circuit is producing set or erase voltages for such electrodes;

wherein the diode network in each of said integrated circuits comprises a plurality of pairs of diodes, the anode of one diode of each such pair being connected to the cathode of the other diode of such pair, such common connection of each diode pair being connected to said interface circuit, and the remaining electrode of one of the diodes in each such pair being connected to the output terminal of the amplifier which is connected to such diode network.

2. A control circuit in accordance with claim 1, wherein there are a plurality of integrated circuits for each of said networks, a single amplifier for one of said networks, and two amplifiers for the other of said networks.

3. A control circuit in accordance with claim 2, wherein each of said integrated circuits further comprises a logic circuit which in response to low voltage logic instructions supplied thereto produces control signals which it applies to the interface circuit comprised in such integrated circuit, such control signals controlling the interface circuit to produce set and erase voltages for those of said electrodes identified by such logic instructions.

4. A control circuit in accordance with claim 3, further comprising means for supplying each of the interface circuits comprised in each of the integrated circuits for one of said electrode networks with a sloping low voltage signal and a constant direct voltage signal, the voltages produced by such integrated circuits for each of the electrodes in such electrode network being one of such signal voltages as determined by the logic instructions supplied to the logic circuits comprised in the corresponding integrated circuits.

* * * * *